US005746506A

United States Patent [19]

Dunbar

[11] Patent Number: 5,746,506

[45] Date of Patent: May 5, 1998

[54] REMOVABLE LAMPSHADE COVER AND METHOD THEREFOR

[76] Inventor: Belinda W. Dunbar, 52 W. Lynwood St., Phoenix, Ariz. 85003

[21] Appl. No.: 550,341

[22] Filed: Oct. 30, 1995

[51] Int. Cl.[6] ..... F21V 1/06

[52] U.S. Cl. ..... 362/351; 362/357; 362/806; 362/352; 493/950

[58] Field of Search ..... 362/351, 352, 362/355, 356, 357, 359, 361; 493/950

[56] References Cited

U.S. PATENT DOCUMENTS

| | | | |
|---|---|---|---|
| 1,459,715 | 6/1923 | Bliss | 362/357 |
| 2,224,950 | 12/1940 | Burke | 362/358 |
| 4,354,222 | 10/1982 | Gall | 362/352 |
| 4,646,216 | 2/1987 | Chong et al. | 362/357 |
| 4,731,715 | 3/1988 | Anderson | 362/361 |
| 5,193,902 | 3/1993 | Hyland et al. | 362/357 |

OTHER PUBLICATIONS

Sears Catalog 1993 Spring/Summer Annual pp. 488–490.

*Primary Examiner*—Ira S. Lazarus
*Assistant Examiner*—Thomas M. Sember
*Attorney, Agent, or Firm*—Harry M. Weiss; Jeffrey D. Moy; Harry M. Weiss & Associates, P.C.

[57] ABSTRACT

The present invention is directed to a removable lampshade cover and method therefor. The removable lampshade cover is comprised of a tubular band of material having a top opening and a bottom opening, which band of material may be in any shape—including cylindrical or conical—to correspond to the shape of an existing lampshade. In one embodiment, the lampshade cover is circumscribed at its top by an elastic band, for releasably attaching to the top of an existing lampshade. In a second embodiment, the lampshade cover is also circumscribed at its bottom by an elastic band, so that the lampshade cover may be releasably attached to both the top and the bottom of an existing lampshade.

10 Claims, 1 Drawing Sheet

REMOVABLE LAMPSHADE COVER AND METHOD THEREFOR

BACKGROUND OF THE INVENTION

1. Field of Invention

This invention relates generally to lampshades and methods therefor and, more particularly, to a removable lampshade cover that may be placed over an existing lampshade and to a method therefor.

2. Background of the Invention

Individuals seeking to decorate the interior of a room currently have a number of options when it comes to the decoration of a lamp. One option is to purchase lampshade covers that are neutral in color—for example white or off-white—so that they will match the furniture, wallcovering, bed covering, and/or flooring in essentially any room in a home. Another option is to purchase a lampshade cover with a color that matches the interior of the room—e.g., a blue lampshade for a room that is decorated in blue. A final option, and the most expensive one, is to purchase a lampshade cover that incorporates the design of the other fabrics in the room.

The prior art contains several examples of lampshade kits or structures that permit a user to change the appearance of an existing lampshade without purchasing a new shade.

For example, U. S. Pat. No. 5,211,474, issued to Leitner, et al., discloses a do-it-yourself lampshade kit, comprising a styrene lampshade cover and a stiff paper pattern, which can be attached with an adhesive to the styrene lampshade cover. However, the design in Leitner requires the use of a lampshade cover made from a material—styrene in the preferred embodiment—to which a stiff paper or fabric pattern may be adhered. Accordingly, the design in Leitner may not be used to decorate an existing lampshade, the cover of which is not designed to have a cover adhered to its surface. Moreover, even to the extent that an existing lampshade cover has a surface that may accept an adhesive, the design in Leitner permits only a one-time change of a lampshade cover, and does not disclose a device for permitting multiple changes to the surface of an existing lampshade.

U.S. Pat. No. 4,068,120, issued to Throckmorton, et al., also discloses a lampshade structure which, like the design in Leitner, provides for the adherence of specially designed panels to a polystyrene lampshade. Further, the design in Throckmorton discloses the use of a contact adhesive layer on the surface of the polystyrene lampshade, which shade is divided into panel sections, for receiving removable panel sections that are shaped to correspond to the panel sections of the lampshade. To mask the seams between the individual panels and at the top and the bottom of the lampshade, the device disclosed in Throckmorton requires the use of banding ribbon. The device disclosed in Throckmorton has many of the same drawbacks as the device disclosed in Leitner—the Throckmorton design may not used to decorate most existing lampshades, unless the cover is polystyrene and is covered with a contact adhesive. Moreover, the lampshade in Throckmorton may only be covered with panels that correspond in shape to the lampshade base. Additionally, the device in Throckmorton is complex and thus relatively expensive to manufacture.

U.S. Pat. No. 3,825,743, issued to Riley, discloses a multi-changeable lampshade. The device in Riley discloses the use of an elongated, hollow, translucent cylinder open at both ends, with parallel spaced notched tracks on the outer surface of such cylinder. The cylinder, which is made of a heat-resistant material, is mounted on top of an adaptor and covers the light bulb. Wire frames of different shapes may be inserted into the tracks on the cylinder, and sleeves of stretchable shade material may be fitted over the wire frames to form lampshades of different shapes and sizes. The device in Riley, like those in Leitner and Throckmorton, does not adequately address the problems faced by a user looking for an inexpensive method for changing the appearance of an existing lampshade. The device in Riley is expensive and complicated, and requires a special apparatus, including an adaptor, a heat resistant translucent cylinder with notched tracks, and an assortment of wire frames. The device in Riley may not be used with an existing lamp or with an existing lampshade.

Therefore, a need existed to provide an improved lampshade cover and method therefor. The improved lampshade cover and method must be capable of being used with an existing lamp and lampshade, regardless of the shape of the lampshade. The improved lampshade cover and method must also be capable of being readily attached to and removed from an existing lampshade without the use of adhesives and without damaging the existing lampshade. The improved lampshade and method must permit the convenient and relatively inexpensive changing of the appearance of an existing lampshade, to correspond with a change in room decor, for a special occasion, or for any other reason. The improved lampshade cover and method must also be capable of having a pattern thereon.

SUMMARY OF THE INVENTION

It is an object of the present invention to provide an improved lampshade cover and method therefor.

It is another object of the present invention to provide an improved lampshade cover and method therefor, which permits the ready and inexpensive addition of a lampshade cover to an existing lampshade without the use of adhesives.

It is a further object of the present invention to provide an improved lampshade cover and method therefor, which permits the removal of the lampshade cover of the present invention from an existing lampshade without damaging the existing lampshade.

It is still another object of the present invention to provide an improved lampshade cover and method therefor which provides an easy attach, quick detach arrangement wherein the lampshade cover comprises a tubular band of material having a top opening and bottom opening, where the tubular band of material can cover a lampshade of any shape, including cylindrical or conical; and elastic clasping means circumscribing the top opening of the tubular band of material for releasably attaching the lampshade cover to the top portion of an existing lampshade. It is a still further object of the present invention to provide an improved lampshade cover and method therefore which provides an easy attach, quick detach arrangement wherein the lampshade cover comprises a tubular band of material having a top opening and bottom opening, where the tubular band of material can cover a lampshade of any shape, including cylindrical or conical; elastic clasping means circumscribing the top opening of the tubular band of material for releasably attaching the lampshade cover to the top portion of an existing lampshade; and elastic clasping means circumscribing the bottom opening of the tubular band of material for releasably attaching the lampshade cover to the bottom portion of an existing lampshade.

BRIEF DESCRIPTION OF THE PREFERRED EMBODIMENTS

In accordance with one embodiment of the present invention, a lampshade cover is disclosed. The lampshade cover is comprised of shading means, which shading means further comprises a tubular band of material having a top opening and bottom opening, where the tubular band of material is of any shape, including cylindrical or conical; and elastic clasping means circumscribing the top opening of the tubular band of material for releasably attaching the top portion of the lampshade cover to the top portion of an existing lampshade.

In accordance with another embodiment of the present invention, a lampshade cover is disclosed. The lampshade cover is comprised of shading means, which shading means further comprises a tubular band of material having a top opening and bottom opening, where the tubular band of material is of any shape, including cylindrical or conical; elastic clasping means circumscribing the top opening of the tubular band of material for releasably attaching the top portion of the lampshade cover to the top portion of an existing lampshade; and elastic clasping means circumscribing the bottom opening of the tubular band of material for releasably attaching the bottom portion of the lampshade cover to the bottom portion of an existing lampshade.

In accordance with still another embodiment of the present invention, a method for covering an existing lampshade is disclosed. The method comprises the steps of: providing shading means, which shading means further comprises a tubular band of material having a top opening and bottom opening, where the tubular band of material is of any shape, including cylindrical or conical; and providing elastic clasping means circumscribing the top opening of the tubular band of material for releasably attaching the top portion of the lampshade cover to the top portion of an existing lampshade.

In accordance with a further embodiment of the present invention, a method for covering an existing lampshade is disclosed. The method comprises the steps of: providing shading means, which shading means further comprises a tubular band of material having a top opening and bottom opening, where the tubular band of material is of any shape, including cylindrical or conical; providing elastic clasping means circumscribing the top opening of the tubular band of material for releasably attaching the top portion of the lampshade cover to the top portion of an existing lampshade; and providing elastic clasping means circumscribing the bottom opening of the tubular band of material for releasably attaching the bottom portion of the lampshade cover to the bottom portion of an existing lampshade.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
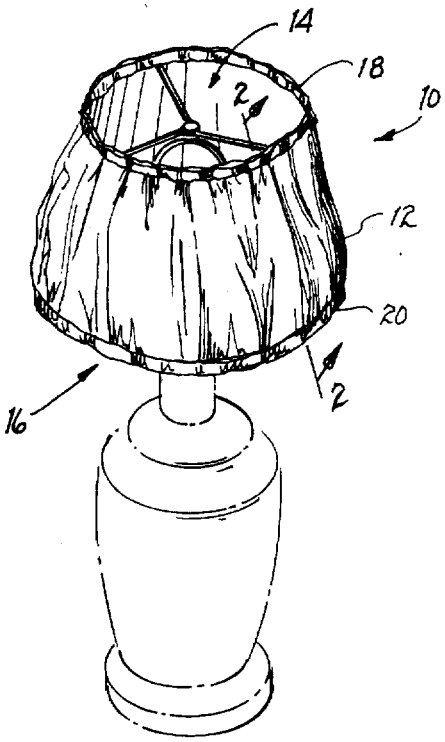
FIG. 1 is a perspective view of the lampshade cover of the present invention, wherein the shape of the lampshade cover is conical and wherein there are elastic bands circumscribing the top and bottom openings of the lampshade cover.
Figure 3:
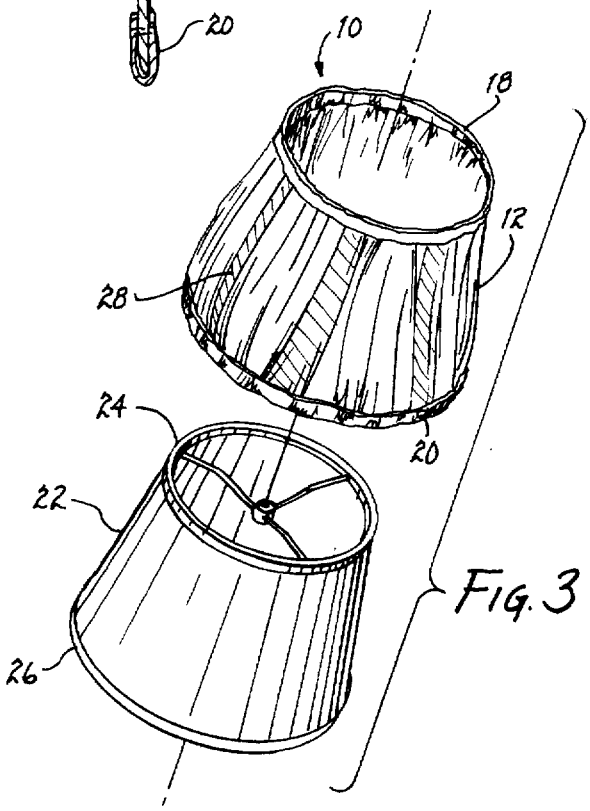
FIG. 3 is an exploded perspective view of the lampshade cover of FIG. 1 prior to attachment to a lampshade.
Figure 5:
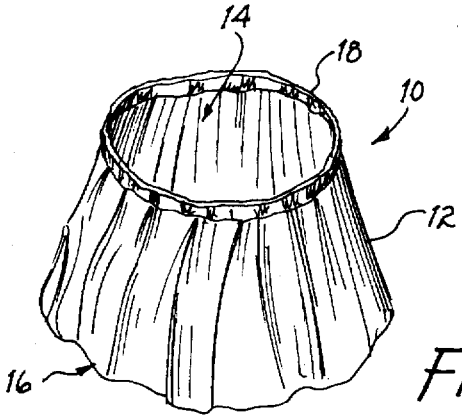
FIG. 5 is a perspective view of another embodiment of the lampshade cover of the present invention, wherein the shape of the lampshade cover is conical and wherein there is an elastic band circumscribing only the top opening of the lampshade cover.

Referring to the embodiment of FIGS. 1, 3, and 5, reference number 10 refers generally to the lampshade cover of this invention. A band of material 12 is shown, in this embodiment, defining a top opening 14 and a larger bottom opening 16, so that the band of material 12 is conical in shape. Circumscribing the top opening 14 is an elastic band 18, and circumscribing the bottom opening 16 is an elastic band 20 (see FIGS. 1 and 3). The lampshade cover 10 is slid into position over the top of an existing lampshade 22, with the elastic band 18 grasping the top rim 24 of an existing lampshade 22 and the elastic band 20 grasping the bottom rim 26 of an existing lampshade (see FIG. 3). The band of material 12 may be decorated with any pattern 28. The word pattern as used herein could designate any shape, design or color for the band of material 12.

Figure 2:
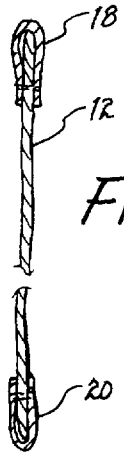
FIG. 2 is a cross-sectional view of the lampshade cover of FIG. 1 taken along line 2—2.

Referring to FIG. 2, a cross-sectional view of the lampshade cover 10 of figure 1 is shown. In this figure, the band of material 12 is seen bordered at the top by the elastic band 18, and at the bottom by the elastic band 20.

Figure 4:
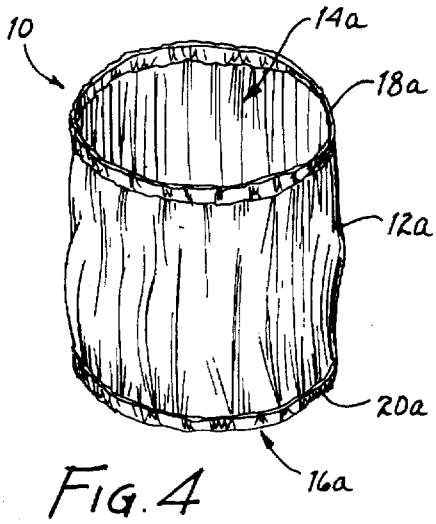
FIG. 4 is a perspective view of the lampshade cover of the present invention, wherein the shape of the lampshade cover is cylindrical and wherein there are elastic bands circumscribing the top and bottom openings of the lampshade cover.

Referring to FIG. 4, a perspective view of another embodiment of the lampshade cover of the present invention is shown. In this embodiment, a band of material **12*a* is shown, defining a top opening 14*a* and a larger bottom opening 16*a*, so that the band of material 12*a* is cylindrical in shape. Circumscribing the top opening 14*a* is an elastic band 18*i*, and circumscribing the bottom opening 16*a* is an elastic band 20*a*. In this embodiment, the lampshade cover 10 is slid into position over the top of an existing lampshade (not shown), in the manner shown in FIG. 3** and described above, where the lampshade (not shown) is cylindrical rather than conical in shape.

Referring to FIG. 5, a perspective view of another embodiment of the lampshade cover of the present invention is shown. In this embodiment, the top opening 14 in the band of material 12 is circumscribed by a an elastic band 18. The bottom opening 16 is not, in this embodiment, circumscribed by an elastic band in the manner shown in FIGS. 1–4. The lampshade cover 12 of FIG. 5 is slid into position over an existing lampshade (not shown), in the manner shown in FIG. 3 and as described above, except that there is no bottom elastic 20 to circumscribe the bottom rim of the lampshade (not shown).

While the invention has been particularly shown and described with reference to preferred embodiments thereof, it will be understood by those skilled in the art that the foregoing and other changes in form and details may be made therein without departing from the spirit and scope of the invention.

I claim:

1. A removable lampshade cover comprising, in combination:

shading means for covering an existing lampshade of a variety of shapes;

said shading means comprising a tubular band of material and having a top opening and a bottom opening;

elastic clasping means substantially circumscribing said top opening of said shading means for releasably attaching said shading means substantially to the top portion of an existing lampshade; and elastic clasping means substantially circumscribing said bottom opening of said tubular band of material for releasably attaching said shading means substantially to the bottom portion of an existing lampshade, said elastic clamping means substantially circumscribing said top opening and said bottom opening of said tubular band of material comprising a u-shaped elastic member located around and connected to a top edge portion and a bottom edge portion of said tubular band of material.

2. A removable lampshade cover in accordance with claim 1, wherein said band of material has a cylindrical shape.

3. A removable lampshade cover in accordance with claim 1, wherein said band of material has a conical shape.

4. A removable lampshade cover in accordance with claim 1, wherein said tubular band of material has a pattern or design thereon.

5. A removable lampshade cover in accordance with claim 1, wherein said tubular band of material has a pattern or design thereon.

6. A method for removably covering an existing lampshade, comprising the steps of:

providing shading means for covering an existing lampshade of a variety of shapes;

said shading means comprising a tubular band of material and having a top opening and a bottom opening;

providing elastic clasping means substantially circumscribing said top opening of said shading means for releasably attaching said shading means substantially to the top portion of an existing lampshade;

providing elastic clasping means substantially circumscribing said bottom opening of said tubular band of material for releasably attaching said shading means substantially to the bottom portion of an existing lampshade, said elastic clamping means substantially circumscribing said bottom opening of said tubular band of material for releasably attaching said shading means substantially to the bottom portion of an existing lampshade, said elastic clamping means substantially circumscribing said top opening and said bottom opening of said tubular band of material comprising a u-shaped elastic member located around and connected to a top edge portion and a bottom edge portion of said tubular band of material;

sliding said tubular band of material over an existing lampshade;

securing said elastic clasping means substantially circumscribing said top opening of said shading means substantially to the top portion of an existing lampshade; and securing said elastic clasping means substantially circumscribing said bottom opening of said shading means substantially to the bottom portion of an existing lampshade.

7. The method of claim 6, further comprising the step of providing a band of material having a cylindrical shape.

8. The method of claim 6, further comprising the step of providing a band of material having a conical shape.

9. The method of claim 6, further comprising the step of providing a band of material having a pattern or design thereon.

10. The method of claim 6, further comprising the step of providing a band of material having a pattern or design thereon.

* * * * *